US010161668B2

(12) United States Patent
Sim et al.

(10) Patent No.: US 10,161,668 B2
(45) Date of Patent: Dec. 25, 2018

(54) REFRIGERATOR

(71) Applicant: Samsung Electronics Co., Ltd, Gyeonggi-do (KR)

(72) Inventors: Seong Hyeon Sim, Gwangju (KR); Ho Sang Park, Gwangju (KR); Kwon Chul Yun, Gwangju (KR); Eui Young Chang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/424,722

(22) Filed: Feb. 3, 2017

(65) Prior Publication Data

US 2017/0227277 A1 Aug. 10, 2017

(30) Foreign Application Priority Data

Feb. 5, 2016 (KR) ..... 10-2016-0015164

(51) Int. Cl.
*F25D 21/14* (2006.01)
*F25D 11/02* (2006.01)
*F25D 23/06* (2006.01)

(52) U.S. Cl.
CPC ..... *F25D 21/14* (2013.01); *F25D 11/022* (2013.01); *F25D 23/066* (2013.01); *F25D 2201/126* (2013.01); *F25D 2321/143* (2013.01)

(58) Field of Classification Search
CPC .. F25D 2321/143; F25D 23/00; F25D 23/066; F25D 21/14; F25D 2321/146; F25D 23/006; F25D 23/067; F25D 23/061; B29L 2031/7622
See application file for complete search history.

(56) References Cited

FOREIGN PATENT DOCUMENTS

| | | | |
|---|---|---|---|
| DE | 29715231 | U1 * | 12/1998 |
| JP | 618146 | A | 1/1994 |
| JP | 1151549 | A | 2/1999 |
| JP | 2000105062 | A | 4/2000 |
| JP | 2005233508 | A | 9/2005 |
| KR | 1020090062128 | | 6/2009 |
| KR | 1020100005530 | | 1/2010 |
| KR | 1020130017010 | | 2/2013 |
| KR | 1020140123614 | | 10/2014 |
| KR | 1020150120178 | | 10/2015 |
| WO | 2015165526 | A1 | 11/2015 |

OTHER PUBLICATIONS

DE 29715231 Translation.*
European Patent Office, "European Search Report," Application No. EP16199675, dated Apr. 10, 2017, 7 pages.

* cited by examiner

*Primary Examiner* — Elizabeth Martin

(57) ABSTRACT

The present application discloses a refrigerator capable of easily fixing a drain hose to one side of an inner case without having an additional fixing member used of fixing a drain hose. A refrigerator having an inner case configured to have a storage compartment formed therein; an outer case disposed outside the inner case and spaced a predetermined distance away from the inner case; a drain hose connected to one side of the inner case and disposed in an inner space formed between the inner case and the outer case; and a connector configured to connect the drain hose to the inner case, wherein the connector is mounted in the inner case using a hooking method.

20 Claims, 10 Drawing Sheets

REFRIGERATOR

CROSS-REFERENCE TO RELATED APPLICATION(S) AND CLAIM OF PRIORITY

This application claims the benefit of Korean Patent Application No. 10-2016-0015164, filed on Feb. 5, 2016 in the Korean Intellectual Property Office, the disclosure of which is incorporated herein by reference.

TECHNICAL FIELD

The present disclosure relates to a refrigerator with an improved structure for fixing a drain member.

BACKGROUND

A refrigerator is an apparatus for storing food at a low temperature. A refrigerator includes a freezer compartment configured to store food at a relatively low temperature and a refrigerator compartment configured to store food at a relatively high temperature compared to the freezer compartment.

Cold air supplied to the freezer compartment and the refrigerator compartment may be generated by a heat exchange with a refrigerant. The refrigerant may exchange heat with air by repeatedly circulating through a refrigeration cycle of compression-condensation-expansion-evaporation. The air heat-exchanged with the refrigerant may be supplied to the freezer compartment and the refrigerator compartment by a circulation fan to store food at a desired temperature in the refrigerator.

An evaporator, which is one element that performs the refrigerant cycle, may remove heat from surrounding air to cool the surrounding air. During this process, a condensate condensed according to a change in temperature of the surrounding air may be generated on a surface of the evaporator. The condensate may be collected by a drain pan and be discharged to the outside through a drain member or be moved to a machine compartment to be evaporated.

The drain member may include the drain pan mounted at one side of an inner case at which the evaporator is installed and a drain hose connected to the drain pan to guide the collected condensate. An insulator may be foamed at an outside of the inner case at which the drain member is disposed. When the insulator is being foamed, the drain member needs to be fixed while being assembled to the outside of the inner case so as not to move.

SUMMARY

According to an embodiment, a refrigerator having a structure in which a drain hose is fixed to one side of an inner case by a hook structure to prevent movement of the drain hose is provided.

In accordance with one aspect of the present disclosure, a refrigerator includes an inner case configured to have a storage compartment formed therein; an outer case disposed outside the inner case and spaced a predetermined distance away from the inner case; a drain hose connected to one side of the inner case and disposed in an inner space formed between the inner case and the outer case; and a connector configured to connect the drain hose to the inner case, wherein the connector is mounted in the inner case using a hooking method.

A fixing protrusion may be formed at the inner case, and a fixing hole into which the fixing protrusion is inserted may be formed at the connector.

A plurality of fixing protrusions and fixing holes may be provided.

The inner case may include a first surface and a second surface bent from the first surface, and the connector may include a first connection surface and a second connection surface corresponding to the first surface and the second surface, respectively.

The fixing protrusion may be disposed at each of the first surface and the second surface, and the fixing hole may be formed at each of the first connection surface and the second connection surface.

The fixing protrusion may include a first protruding surface configured to extend from one surface of the inner case and a second protruding surface configured to connect the first protruding surface to the one surface of the inner case, and an angle formed between the first protruding surface and the one surface of the inner case may be smaller than an angle formed between the second protruding surface and the one surface of the inner case.

An insulator may be foamed in the inner space between the inner case and the outer case.

The insulator may be foamed after the drain hose is disposed between the inner case and the outer case.

An evaporator may be provided at one side of the storage compartment, and a drain pan into which a condensate generated at the evaporator is collected may be disposed in the inner case.

The drain hose may be disposed to correspond to the drain pan.

The condensate collected in the drain pan may flow along the drain hose to be drained.

The drain hose may be connected to a water tray provided at one side of the drain hose, and the condensate may be drained to the water tray by the drain hose.

The fixing protrusion may be formed by a mold unit disposed to be rotatable by an external force.

The fixing hole may be formed by cutting a protrusion protruding from one surface of the connector.

The connector and the drain hose may be integrally formed.

In accordance with another aspect of the present disclosure, a refrigerator includes an outer case configured to form an exterior; an inner case disposed inside the outer case and configured to form a storage compartment; an evaporator installed at the inner case; a drain pan disposed at the inner case to collect a condensate generated at the evaporator; and a drain hose configured to drain the condensate collected in the drain pan, wherein a plurality of fixing protrusions are formed at one side of the inner case, and a plurality of fixing holes are formed at one side of the drain hose such that the drain hose is coupled to the inner case by the plurality of fixing protrusions being inserted into the plurality of fixing holes, respectively.

An inner space may be formed between the inner case and the outer case, and the drain hose may extend in the inner space.

An insulator may be foamed in the inner space after the drain hose is coupled to the inner case.

A first surface and a second surface bent from the first surface may be provided at one side of the inner case, and one or more fixing protrusions may protrude from each of the first surface and the second surface.

A connector mounted at one side of the inner case may be provided at one side of the drain hose, and the connector may be formed in a shape corresponding to those of the first surface and the second surface.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, a refrigerator according to an embodiment will be described in detail with reference to the drawings.

Figure 1:
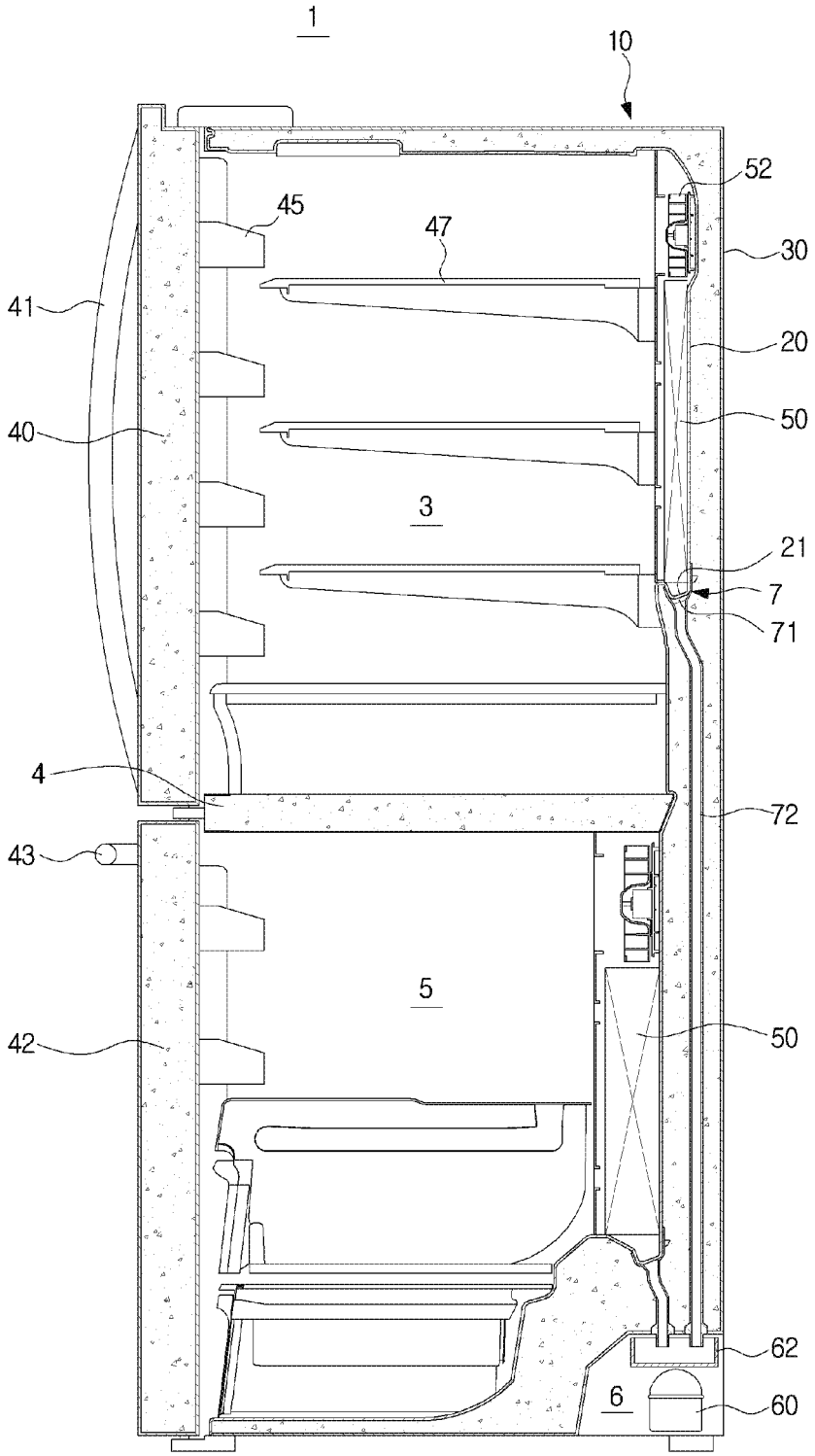
FIG. 1 is a view illustrating a lateral cross-section of a refrigerator according to an embodiment.
Figure 2:
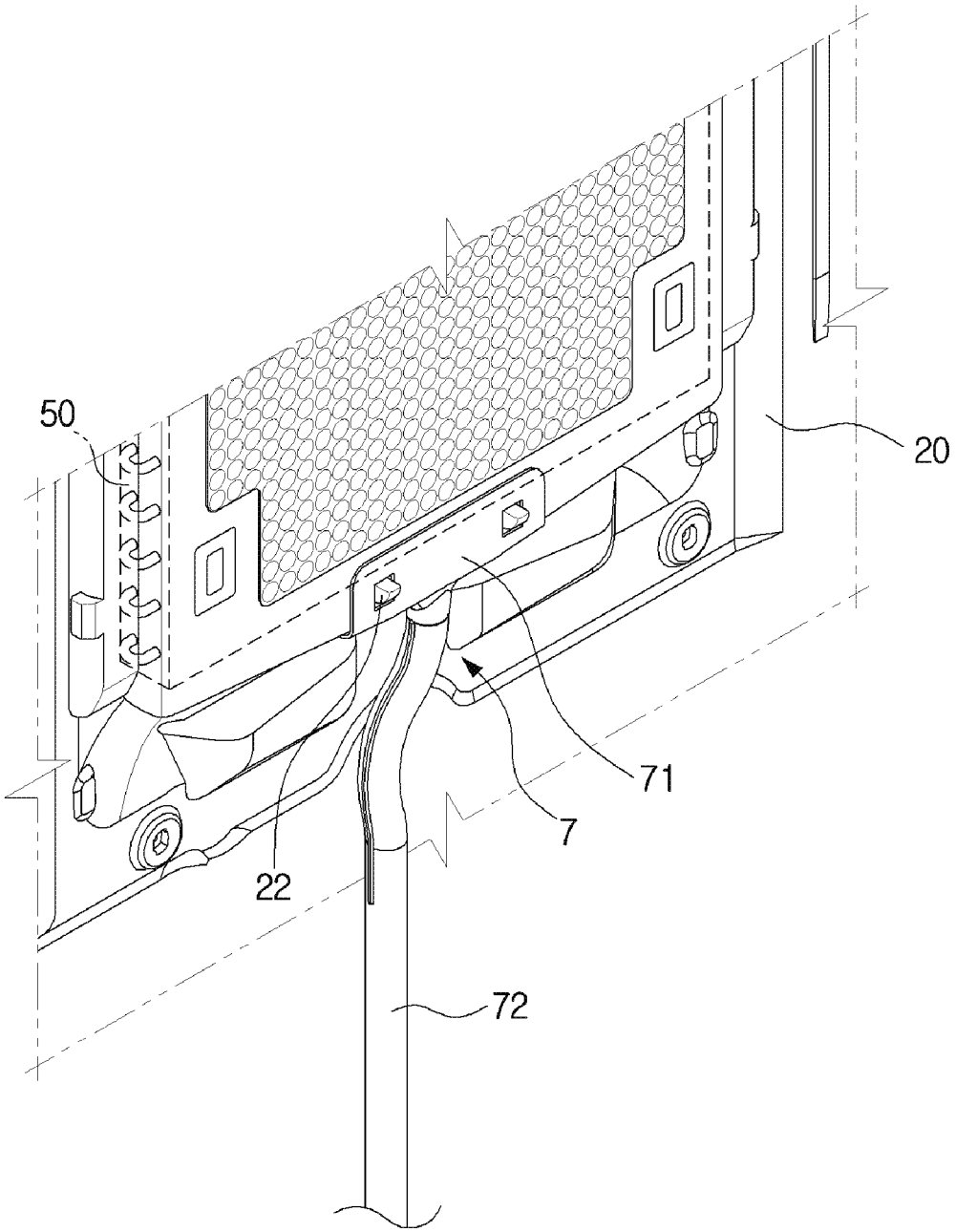
FIG. 2 is a view illustrating a state in which a drain member is coupled to an inner case of the refrigerator according to an embodiment.
Figure 3:
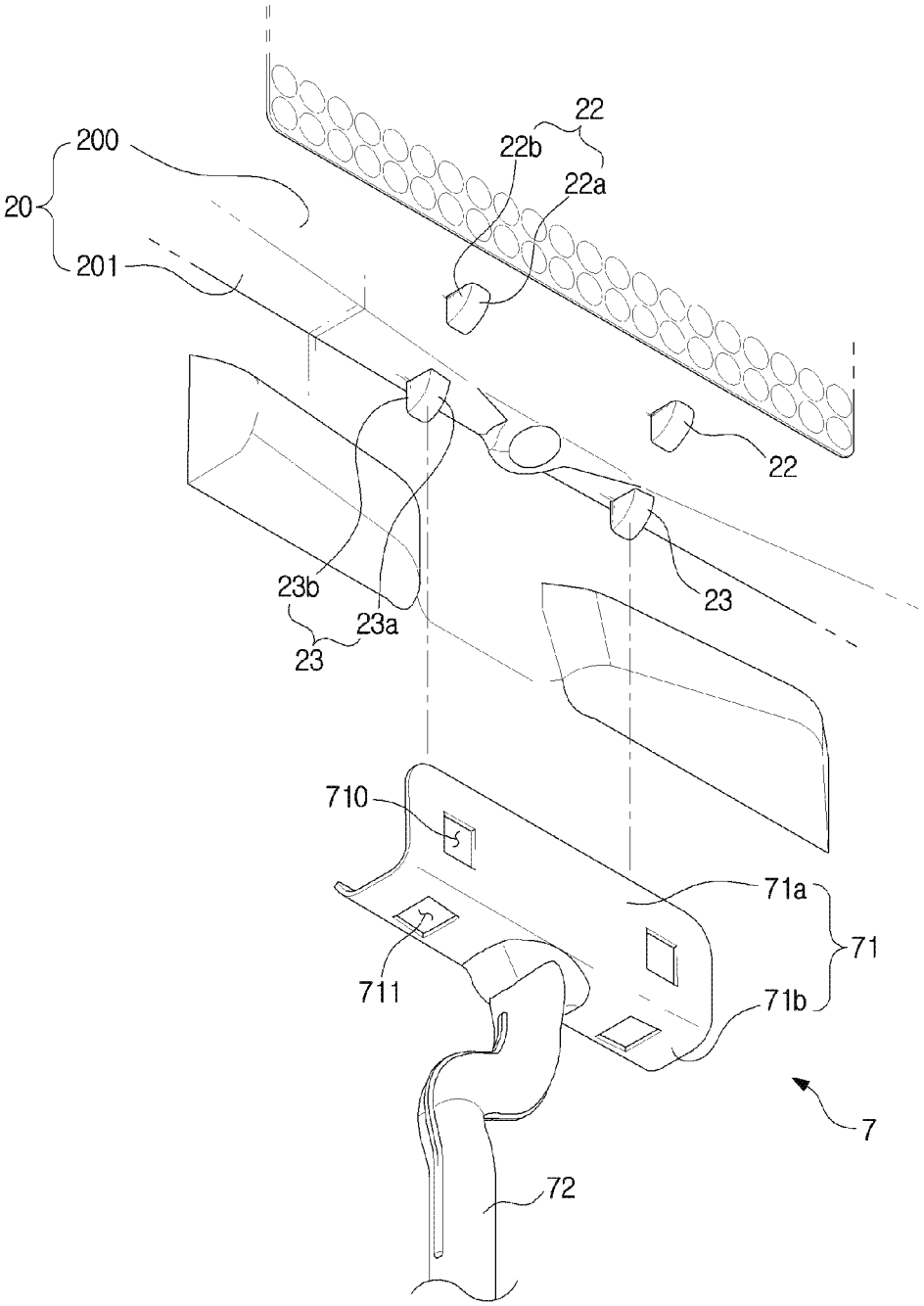
FIG. 3 is an exploded perspective view illustrating an inner case and drain member of the refrigerator according to an embodiment.

FIG. 1 is a view illustrating a lateral cross-section of a refrigerator according to an embodiment, and FIG. 2 is a view illustrating a state in which a drain member is coupled to an inner case of the refrigerator according to an embodiment.

Referring to FIGS. 1 and 2, a refrigerator 1 according to an embodiment includes a main body 10 having storage compartments 3 and 5 provided therein. The main body 10 may include an inner case 20 in which the storage compartments 3 and 5 are formed and an outer case 30 coupled to an outside of the inner case 20. The outer case 30 may form an exterior of the refrigerator 1.

The inner case 20 and the outer case 30 may be spaced a predetermined distance from each other and an inner space 100 may be formed therebetween. An insulator may be disposed in the inner space 100. The inner case 20 may be formed of a polymer material. The outer case 30 may be formed of a metal material for aesthetic sense and durability.

The insulator may be disposed in the inner space 100 disposed between the inner case 20 and the outer case 30. A foamed urethane foam may be used as the insulator. The insulator may be formed by injecting an undiluted urethane solution into the inner space 100 formed after the inner case 20 and the outer case 30 are coupled and foaming and hardening the undiluted urethane solution.

The storage compartments 3 and 5 may be vertically divided by a partition 4 therebetween. The storage compartments 3 and 5 divided by the partition 4 may include a refrigerator compartment 3 configured to refrigerate and store food and the like and a freezer compartment 5 configured to freeze and store stored goods. Each of the refrigerator compartment 3 and the freezer compartment 5 has an open front surface so that a user may put or take food and the like in or out of each of the refrigerator compartment 3 and the freezer compartment 5.

Although an embodiment in which the refrigerator compartment 3 is disposed above the freezer compartment 5 is disclosed in FIG. 1, the refrigerator compartment 3 may also be disposed below the freezer compartment 5. Hereinafter, the embodiment in which the refrigerator compartment 3 is disposed above the freezer compartment 5 as illustrated in FIG. 1 will be described.

Openings formed at front surfaces of the storage compartments 3 and 5 may be opened and closed by doors 40 and 42, respectively. The doors 40 and 42 may include a refrigerator compartment door 40 and a freezer compartment door 42 respectively provided at the front surfaces of the refrigerator compartment 3 and the freezer compartment 5.

Each of the refrigerator compartment door 40 and the freezer compartment door 42 may be rotatably coupled to the main body 10. The refrigerator compartment door 40 or the freezer compartment door 42 may also be disposed to be drawable as a drawer from the main body 10. Handles 41 and 43 may be respectively provided at front surfaces of the refrigerator compartment door 40 and the freezer compartment door 42 to be gripped by the user.

One or more multistage shelves 47 may be provided in the refrigerator compartment 3 and the freezer compartment 5 to facilitate storage of stored goods. One or more door pockets 45 capable of accommodating stored goods may be provided at an inside of the refrigerator compartment door 40.

One or more inlets 54 through which cold air is introduced may be provided at one side of the storage compartments 3 and 5. The cold air introduced through the one or more inlets 54 may exchange heat with the stored goods and keep the stored goods at a suitable temperature. A circulation fan 52 may be installed at one side of the storage compartments 3 and 5 to convect cold air.

An evaporator 50 configured to exchange heat with air may be installed at one side of the storage compartments 3 and 5. The evaporator 50 may be installed to be fixed to one side of the inner case 20. The evaporator 50 may be connected to a compressor 60 to form a refrigerant cycle. The compressor 60 may be disposed inside a machine compartment 6 formed at a lower portion of the main body 10.

The evaporator 50 may serve to remove heat from surrounding air and lower temperature of the surrounding air. Vapor included in the surrounding air may be condensed and form a condensate on a surface of the evaporator 50 during a heat exchange process. The refrigerator 1 may include a drain member 7 for treating the condensate.

The drain member 7 may be disposed in the inner space 100. The drain member 7 may include a drain pan 21 configured to collect the condensate formed on the surface of the evaporator 50 and a drain hose 72 connected to the drain pan 21. The drain hose 72 may have one side connected to the inner case 20 in which the drain pan 21 is disposed and have the other side extending to a water tray 62 provided inside the machine compartment 6.

The condensate generated on the surface of the evaporator 50 may be collected in the drain pan 21, and the condensate collected in the drain pan 21 may flow along the drain hose 72 to be collected in the water tray 62 disposed inside the machine compartment 6. The condensate collected in the water tray 62 may be evaporated by heat generated in the compressor 60 and a condenser (not illustrated).

Although an embodiment in which the drain hose 72 is disposed to allow the condensate collected in the drain pan 21 to be collected in the water tray 62 inside the machine compartment 6 has been described above, the drain hose 72 may also be disposed to enable the condensate collected in the drain pan 21 to be discharged to the outside.

Hereinafter, a method of manufacturing the refrigerator 1 will be described.

The inner case 20, in which the storage compartments 3 and 5 are formed, and the outer case 30 are provided, and the inner space 100 is provided between the inner case 20 and the outer case 30. The drain hose 72 may be disposed at one side of the inner case 20. The drain hose 72 may be disposed to correspond to the drain pan 21. The drain hose 72 is disposed to extend from the drain pan 21 to the water tray 62 disposed in the machine compartment 6 in the inner space 100. When the drain member 7 is mounted outside the inner case 20, an insulator is foamed in the inner space 100. The drain hose 72 may be fixed by the insulator foamed in the inner space 100.

Since the drain hose 72 is fixed by the insulator foamed in the inner space 100, the drain hose 72 does not have to be completely fastened to an outer surface of the inner case 20 by a fastening member before the insulator is foamed. However, the drain hose 72 has to be fixed to a certain extent so that the drain hose 72 does not move due to pressure of a material being injected into the inner space 100 when the insulator is being foamed.

Hereinafter, a structure in which the drain hose 72 is fixed to one side of the inner case 20 will be described.

Figure 4:
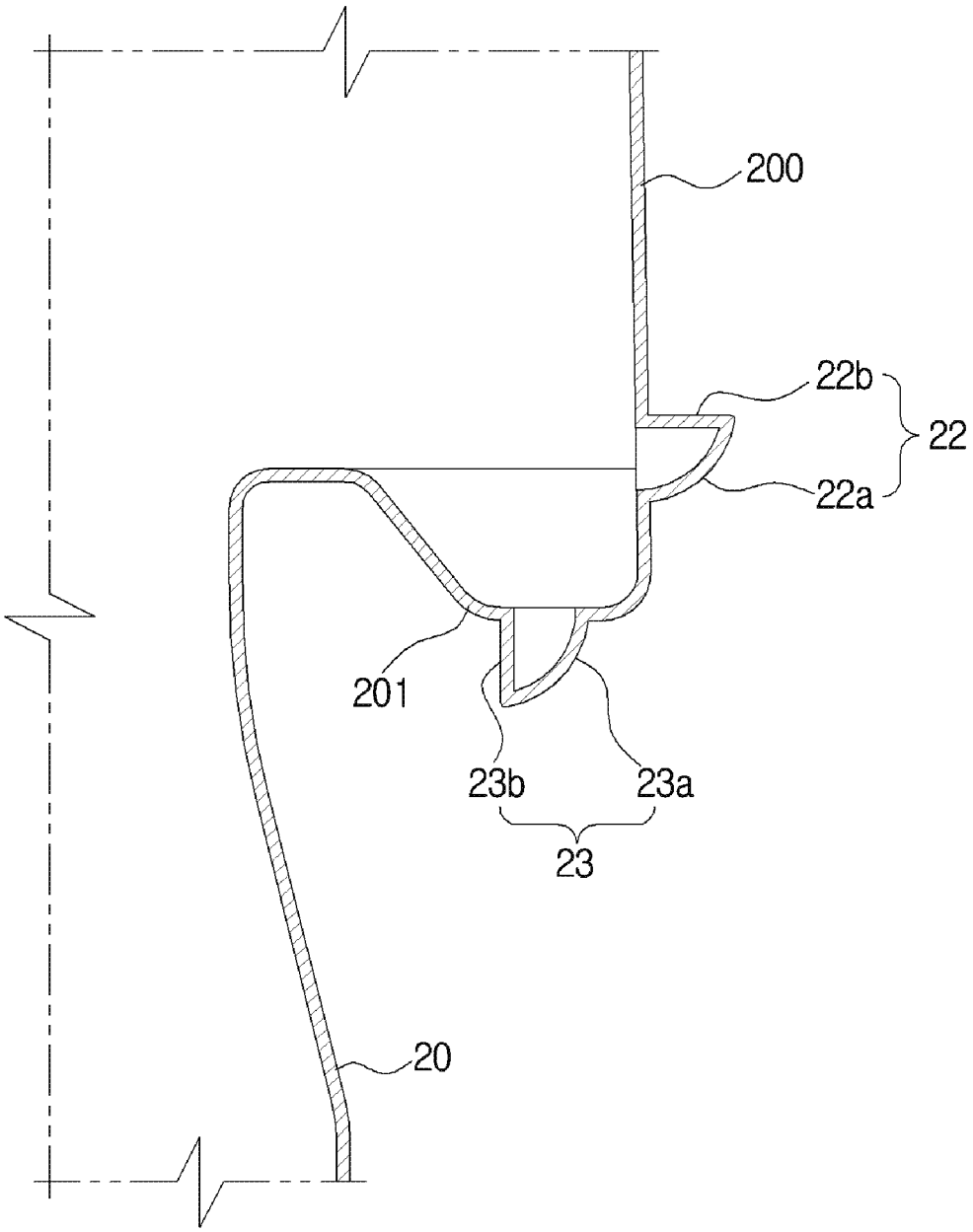
FIG. 4 is a lateral cross-sectional view illustrating a part of an inner case of the refrigerator according to an embodiment.
Figure 5:
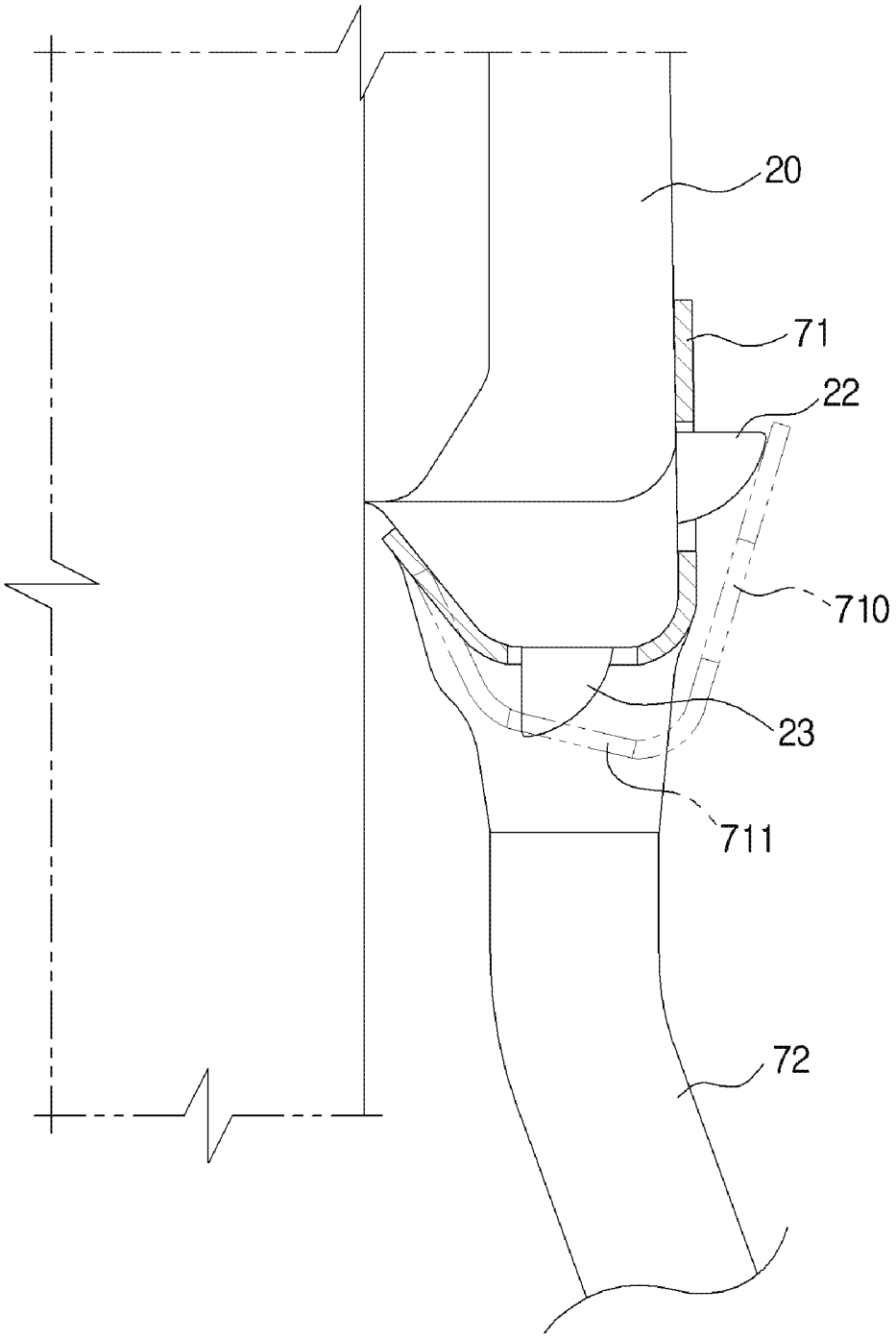
FIG. 5 is a lateral cross-sectional view illustrating a state in which a drain member according to an embodiment is coupled to the inner case.

FIG. 4 is a lateral cross-sectional view illustrating a part of an inner case of the refrigerator according to an embodiment, and FIG. 5 is a lateral cross-sectional view illustrating a state in which a drain member according to an embodiment is coupled to the inner case.

Referring to FIGS. 4 and 5, the drain hose 72 for discharging a condensate formed on a surface of the evaporator 50 may be mounted in the inner case 20 of the refrigerator 1 according to an embodiment. The drain member 7 may include the drain pan 21 disposed at one side of the inner case 20 and the drain hose 72 connected to the drain pan 21. The drain hose 72 may be connected to the drain pan 21 by a connector 71.

The drain pan 21 may be concavely formed to collect the condensate. The drain pan 21 may be integrally formed with the inner case 20. A drain hole 210 for discharging the collected condensate may be formed at the drain pan 21. A connection hole may be formed at the connector 71, and the connection hole may communicate with the drain hole 210. The condensate introduced through the drain hole 210 and the connection hole may flow along the drain hose 72 and be drained to the water tray 62.

The connector 71 may be mounted in the inner case 20 using a hooking method. Fixing protrusions 22 and 23 may protrude from the outer surface of the inner case 20, and fixing holes 710 and 711 into which the fixing protrusions 22 and 23 are respectively inserted may be disposed at the connector 71. A plurality of fixing protrusions 22 and 23 and a plurality of fixing holes 710 and 711 may be disposed.

The inner case 20 may include a first surface 200 configured to form a rear surface of the storage compartments 3 and 5 and a second surface 201 bent from the first surface 200. The first surface 200 and the second surface 201 may be disposed to form a substantially right angle. The drain pan 21 may be provided at one side of the second surface 201.

The fixing protrusions 22 and 23 may be disposed at the first surface 200 and the second surface 201, respectively. A first fixing protrusion 22 may protrude from the first surface 200, and a second fixing protrusion 23 may protrude from the second surface 201.

The connector 71 may be disposed in a shape corresponding to those of the first surface 200 and the second surface 201. The connector 71 includes a first connection surface 71*a* corresponding to the first surface 200 and a second connection surface 71*b* corresponding to the second surface 201. A first fixing hole 710 into which the first fixing protrusion 22 is inserted may be formed at the first connection surface 71*a*, and a second fixing hole 711 into which the second fixing protrusion 23 is inserted may be formed at the second connection surface 71*b*.

A plurality of first fixing protrusions 22, a plurality of second fixing protrusions 23, a plurality of first fixing holes 710, and a plurality of second fixing holes 711 may be provided. For example, two first fixing protrusions 22 may protrude from the first surface 200, and two second fixing protrusions 23 may protrude from the second surface 201. Two first fixing holes 710 may be formed at the first connection surface 71*a* to correspond to the two first fixing protrusions 22, and two second fixing holes 711 may be formed at the second connection surface 71*b* to correspond to the two second fixing protrusions 23.

The numbers of the fixing protrusions 22 and 23 and the fixing holes 710 and 711 are not limited to the above. As described above, the connector 71 may not be easily separated from the inner case 20 due to the plurality of fixing protrusions provided at the two bent surfaces being inserted into the plurality of fixing holes.

In this way, the connector 71 may be fixed to the inner case 20 by the fixing protrusions 22 and 23 inserted into the fixing holes 710 and 711, and an insulator may be foamed in the inner space 100 while the connector 71 is fixed to the inner case 20. Since the insulator is foamed while the connector 71 is fixed to the inner case 20, an error in assembly due to movement of the drain hose 72 may be prevented from occurring.

Although an embodiment in which the first fixing protrusion 22 is formed at the first surface 200 of the inner case 20, the second fixing protrusion 23 is formed at the second surface 201, the first fixing hole 710 is formed at the first connection surface 71*a* of the connector 71, and the second fixing hole 711 is formed at the second connection surface 71*b* of the connector 71 has been described above, the numbers of the fixing protrusions and the fixing holes and positions at which the fixing protrusions and the fixing holes are formed are not limited to the above.

Meanwhile, the fixing protrusions 22 and 23 formed at the inner case 20 may include first fixing protruding surfaces 22*a* and 23*a* having gentle slopes and second fixing protruding surfaces 22*b* and 23*b* having steep slopes. The second fixing protruding surfaces 22*b* and 23*b* may form a substantially right angle with the first surface 200 and the second surface 201, respectively. The first fixing protruding surface 22*a* formed at the first fixing protrusion 22 and the first fixing protruding surface 23*a* formed at the second fixing protrusion 23 may be disposed to face each other. The second fixing protruding surface 22*b* formed at the first fixing protrusion 22 and the second fixing protruding surface 23*b* formed at the second fixing protrusion 23 may be disposed to come into contact with inner surfaces of the fixing holes 710 and 711 formed at the connector 71.

The fixing protrusions 22 and 23 may not easily leave the fixing holes 710 and 711 due to the second fixing protruding surfaces 22*b* and 23*b* with steep slopes interfering with the inner surfaces of the fixing holes 710 and 711. Since the first fixing protruding surfaces 22*a* and 23*a* with gentle slopes are present, the inner case 20 may be easily separated from a mold when the inner case 20 is formed.

Hereinafter, methods of manufacturing the inner case 20 including the fixing protrusions 22 and 23 and the connector 71 including the fixing holes 710 and 711 will be described.

Figure 6A:
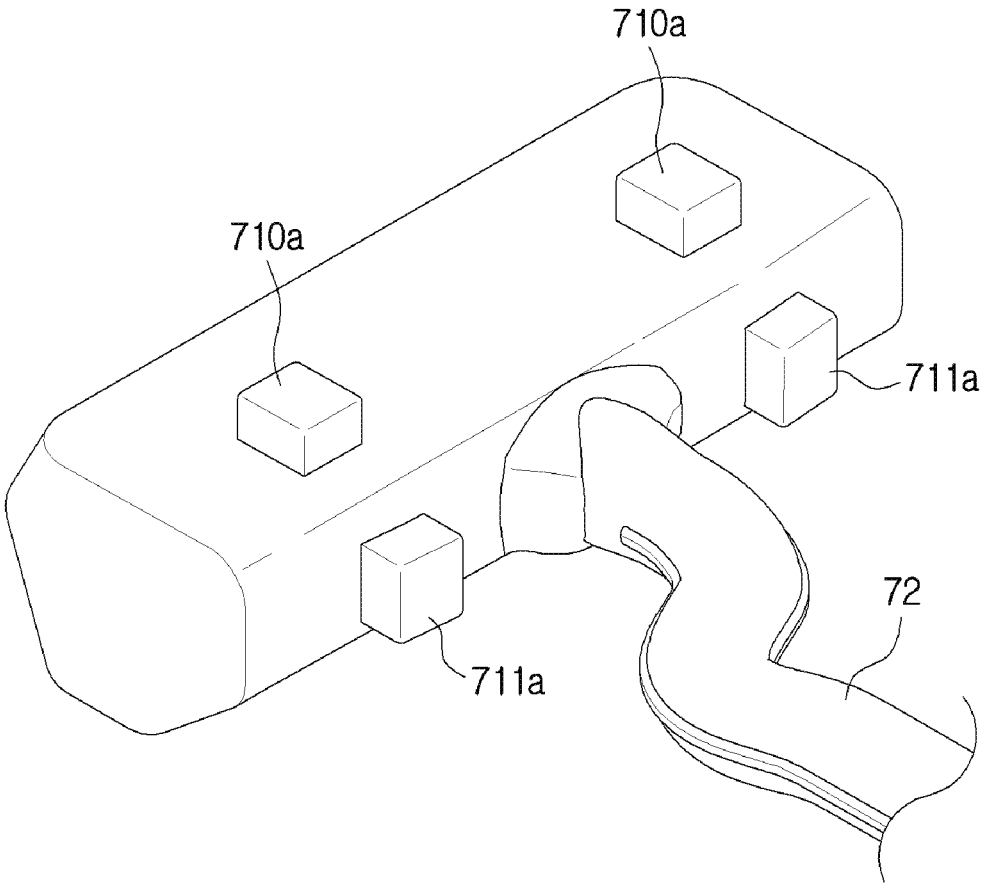
FIGS. 6A, 6B, and 6C are views illustrating a process of manufacturing a connector according to an embodiment.
Figure 6B:
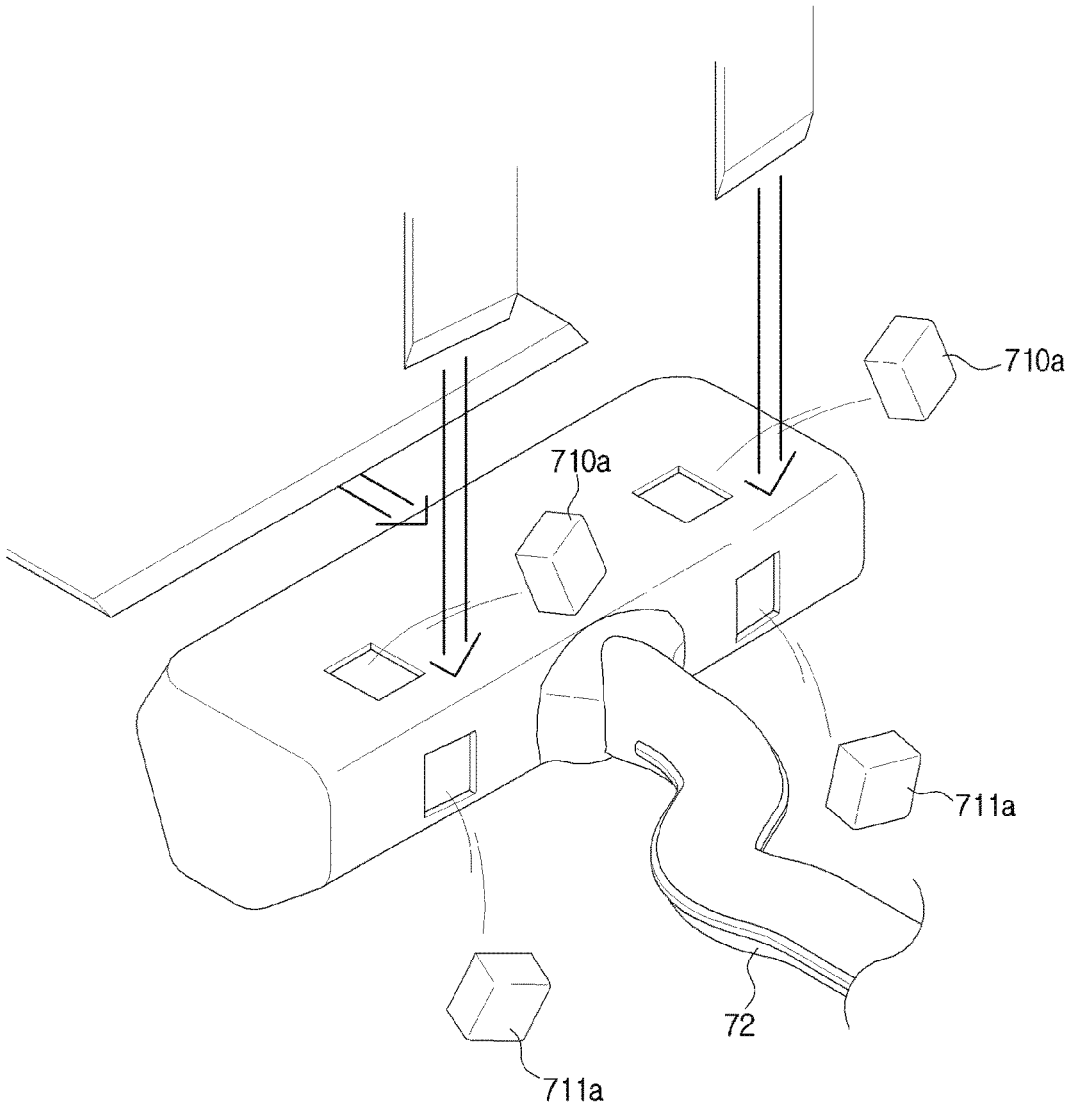
Figure 6C:
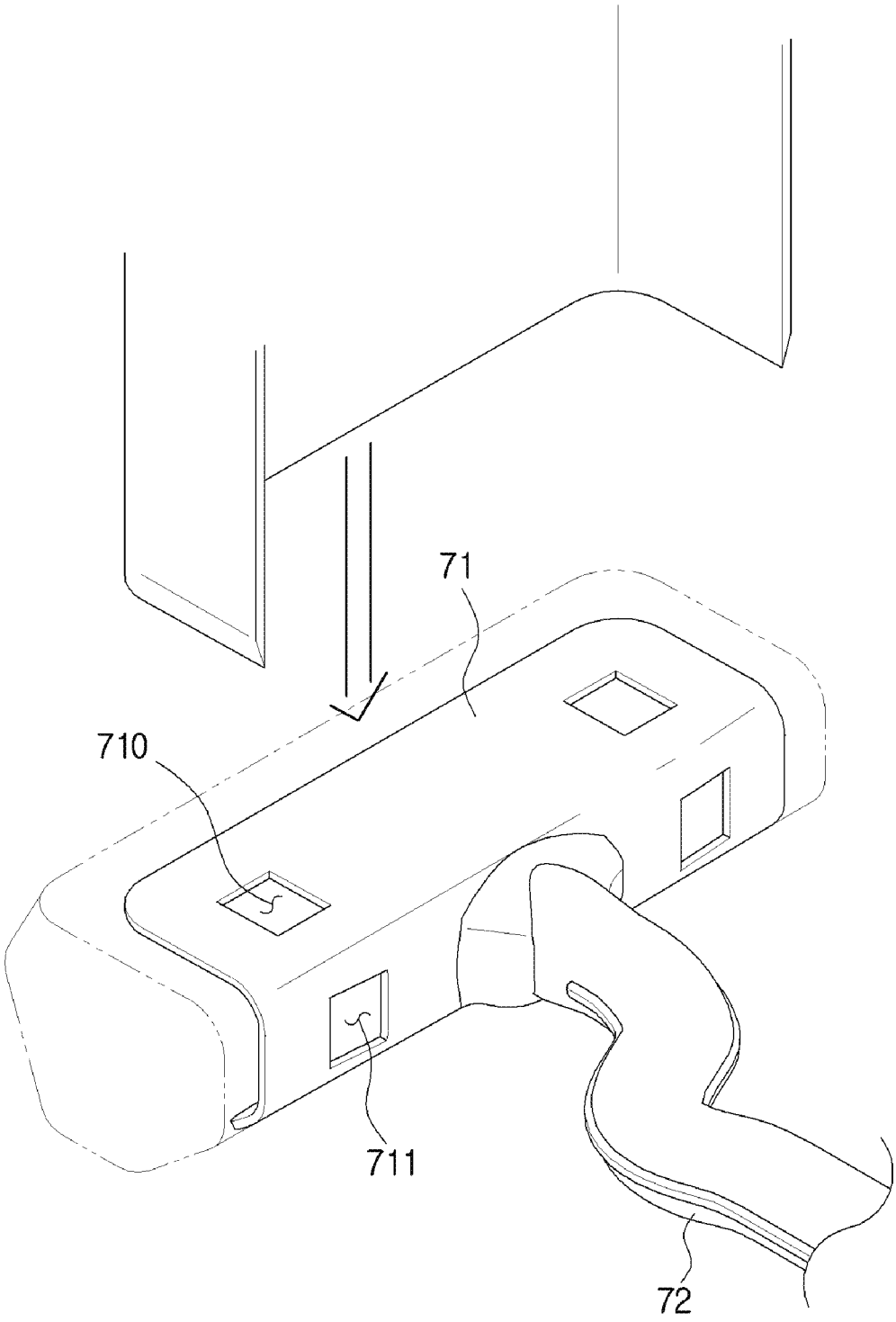

FIGS. 6A to 6C are views illustrating a process of manufacturing a connector according to an embodiment.

Referring to FIGS. 6A to 6C, the connector 71 according to an embodiment may be first provided in the form of a polyhedral body. The polyhedral body may include the first connection surface 71*a* and the second connection surface 71*b*, and a plurality of protrusions 710*a* and 711*a* may be formed at outer circumferential surfaces of the polyhedral body corresponding to the first connection surface 71*a* and the second connection surface 71*b*. An entire surface of the polyhedral body including the protrusions 710*a* and 711*a* may be formed to have the same thickness.

The protrusions 710*a* and 711*a* may be cut using a cutting tool. The fixing holes 710 and 711 may be formed at positions at which the protrusions 710*a* and 710*b* are cut. In addition, one surface of the polyhedral body facing the first connection surface 71*a* and the second connection surface 71*b* may be cut using a blade. In this way, a form of the connector 71 may be completed. One surface of the polyhedral body may be cut using a bent blade. For example, the blade may have a c-shape.

Figure 7A:
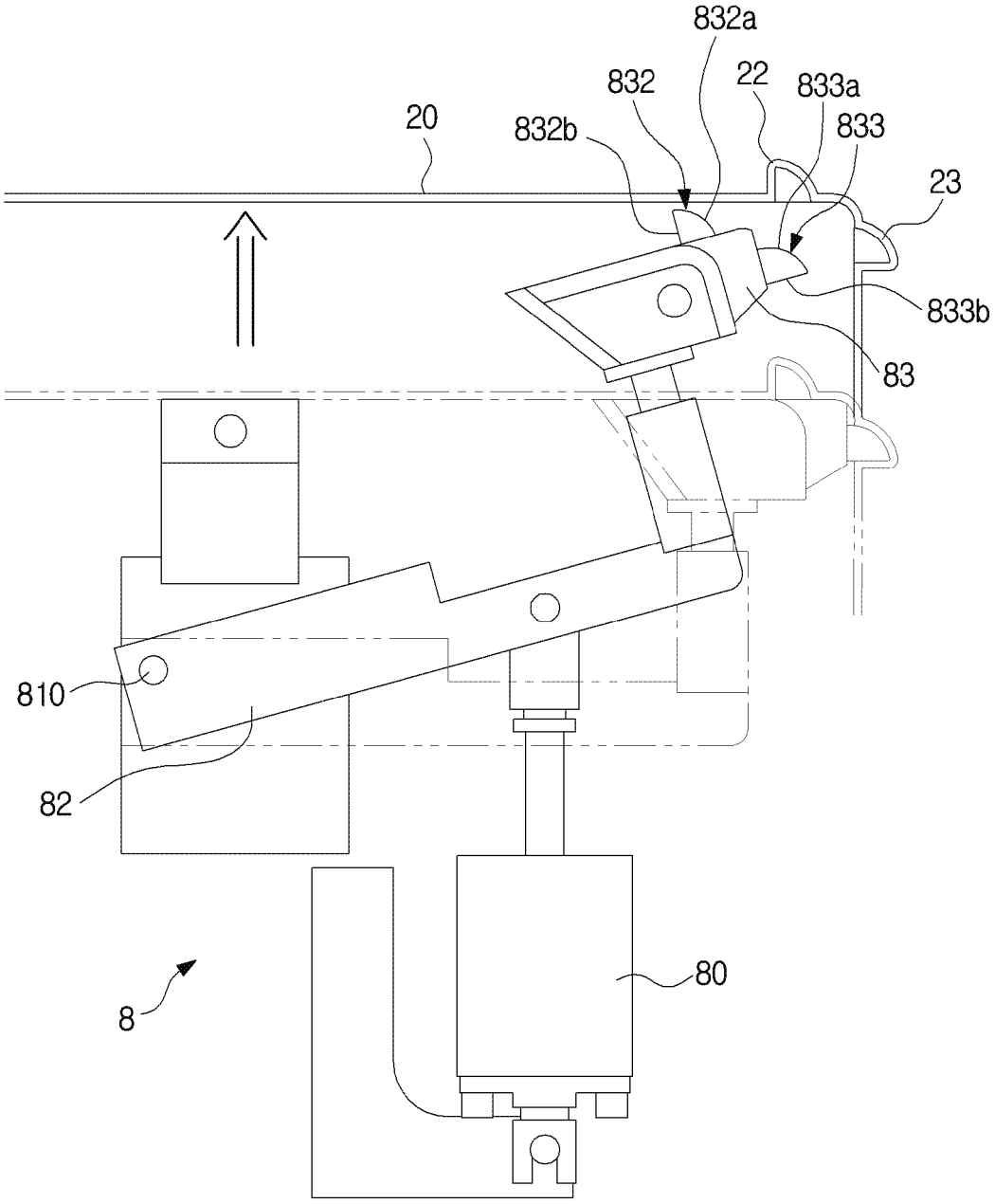
FIGS. 7A and 7B are views illustrating a process of manufacturing an inner case of a refrigerator according to an embodiment.
Figure 7B:
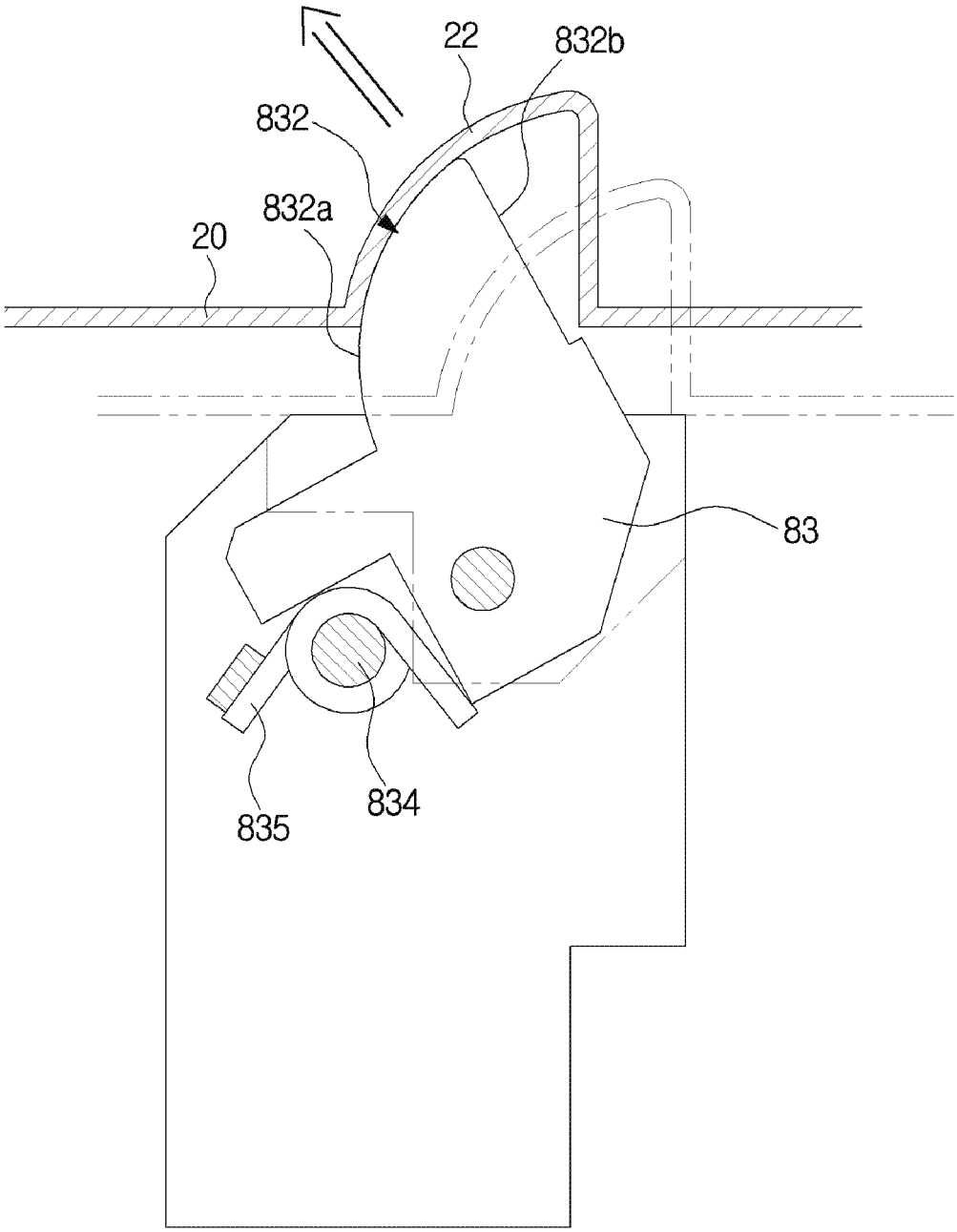

FIGS. 7A and 7B are views illustrating a process of manufacturing an inner case of a refrigerator according to an embodiment.

Referring FIGS. 7A and 7B, the inner case 20 according to an embodiment may be manufactured using a material which is deformable by high-temperature heat. Shapes of the fixing protrusions 22 and 23 may be formed at the inner case 20 by applying heat to a flat panel made of a polymer material.

A mold 8 for manufacturing the inner case 20 may include a supporter 81 and a rotator 82 mounted on the supporter 81. The rotator 82 may be provided to be rotatable about a rotation shaft 810 passing through the supporter 81 and the rotator 82.

A mold unit 83 including protrusions 832 and 833 respectively formed in the shapes of the fixing protrusions 22 and 23 protruding from the surface of the inner case 20 may be mounted at one side of the rotator 82. The protrusions 832 and 833 may include first protruding surfaces 832*a* and 833*a* having gentle slopes and second protruding surfaces 832*b* and 833*b* having steep slopes to correspond to the shapes of the fixing protrusions 22 and 23.

The mold unit 83 may be rotatably connected to the rotator 82 by a rotation shaft 834. The mold unit 83 may rotate in one direction or the other direction together with the rotation shaft 834. The mold unit 83 may receive an elastic force from an elastic member 835 connected thereto. After the mold unit 83 rotates in the one direction due to an external force and then the external force is removed, the mold unit 83 may rotate in the other direction and return to an original state before the external force was applied thereto. The elastic member 835 may be mounted on the rotation shaft 834 to provide the elastic force to the mold unit 83.

When the shapes of the fixing protrusions 22 and 23 are formed by the mold unit 83 so that the first fixing protrusion 22 protrudes upward from the mold unit 83, the inner case 20 may be lifted and ejected. Here, although the first fixing protrusion 22 does not interfere with separating the inner case 20 from the mold unit, the second fixing protrusion 23 may interfere therewith due to the protrusion 833.

In the case of the present disclosure, due to the mold unit 83 being rotatably provided about the rotation shaft 834, the second fixing protrusion 23 may easily leave the protrusion 833 by the mold unit 83 rotating in one direction when the inner case 20 is being ejected. The first fixing protrusion 22 and the second fixing protrusion 23 may be ejected by sliding along the first protruding surfaces 832*a* and 833*a* having gentle slopes.

In this way, the inner case 20 including the fixing protrusions 22 and 23 may be easily ejected from the mold 8 using the mold unit 83.

In a case of the present disclosure, since an insulator is foamed and hardened while the drain hose 72 is mounted in the inner case 20 using the hooking method, an error in assembly of the drain hose 72 may be prevented from occurring. The shapes, numbers, and positions of the fixing holes 710 and 711 formed at the connector 71 and the fixing protrusions 22 and 23 formed at the inner case 20 are not limited to those mentioned above.

In addition, although an embodiment in which the fixing holes are formed at the connector and the fixing protrusions are formed at the inner case has been described above, the fixing protrusions may also be formed at the connector, and the fixing holes may also be formed at the inner case.

In the case of the present disclosure, the drain hose 72 is mounted in the inner case 20 without using a separate fastening member, adhesive member, or the like such that manufacturing costs required to manufacture the fastening member, the adhesive member, and the like may be saved. Also, a fastening process, an adhering process, and the like using the fastening member, the adhesive member, and the like may be omitted such that an amount of time required to produce a product may be reduced.

In the refrigerator according to an embodiment, a drain hose can be easily fixed to one side of an inner case.

In addition, a separate fixing member for fixing the drain hose can be omitted such that material costs can be saved, and an additional task for fixing the drain hose to the inner case by the separate fixing member is not required such that manufacturing time can be shortened.

Embodiments of the present disclosure have been described above to assist in understanding the present disclosure. However, as should be recognized by those or ordinary skill in the art, the present disclosure is not limited by the particular embodiments described herein but may be modified, changed, and substituted in various ways within a scope not departing from the scope of the present disclosure.

What is claimed is:

1. A refrigerator comprising:

an inner case configured to have a storage compartment formed therein;

an outer case disposed outside the inner case and spaced a predetermined distance away from the inner case;

a drain hose connected to one side of the inner case and disposed in an inner space formed between the inner case and the outer case; and a connector configured to connect the drain hose to the inner case, wherein the connector is mounted in the inner case using a hooking method comprising a fixing protrusion is formed at one of the inner case and the connector, and a fixing hole into which the fixing protrusion is inserted at the other one of the inner case and the connector.

2. The refrigerator of claim 1, wherein:

the fixing protrusion is formed at the inner case, and the fixing hole into which the fixing protrusion is inserted is formed at the connector.

3. The refrigerator of claim 2, wherein a plurality of fixing protrusions and fixing holes are provided.

4. The refrigerator of claim 2, wherein the inner case includes a first surface and a second surface bent from the first surface, and the connector includes a first connection surface and a second connection surface corresponding to the first surface and the second surface, respectively.

5. The refrigerator of claim 4, wherein the fixing protrusion is disposed at each of the first surface and the second surface, and the fixing hole is formed at each of the first connection surface and the second connection surface.

6. The refrigerator of claim 4, wherein the fixing protrusion includes a first protruding surface configured to extend from one surface of the inner case and a second protruding surface configured to connect the first protruding surface to the one surface of the inner case, and an angle formed between the first protruding surface and the one surface of the inner case is smaller than an angle formed between the second protruding surface and the one surface of the inner case.

7. The refrigerator of claim 2, wherein the fixing protrusion is formed by a mold unit disposed to be rotatable by an external force.

8. The refrigerator of claim 2, wherein the fixing hole is formed by cutting a protrusion protruding from one surface of the connector.

9. The refrigerator of claim 1, wherein an insulator is foamed in the inner space between the inner case and the outer case.

10. The refrigerator of claim 9, wherein the insulator is foamed after the drain hose is disposed between the inner case and the outer case.

11. The refrigerator of claim 1, wherein an evaporator is provided at one side of the storage compartment, and a drain pan into which a condensate generated at the evaporator is collected is disposed in the inner case.

12. The refrigerator of claim 11, wherein the drain hose is disposed to correspond to the drain pan.

13. The refrigerator of claim 11, wherein the condensate collected in the drain pan flows along the drain hose to be drained.

14. The refrigerator of claim 13, wherein the drain hose is connected to a water tray provided at one side of the drain hose, and the condensate is drained to the water tray by the drain hose.

15. The refrigerator of claim 1, wherein the connector and the drain hose are integrally formed.

16. A refrigerator comprising:

an outer case configured to form an exterior;

an inner case disposed inside the outer case and configured to form a storage compartment;

an evaporator installed at the inner case;

a drain pan disposed at the inner case to collect a condensate generated at the evaporator; and a drain hose configured to drain the condensate collected in the drain pan, wherein a plurality of fixing protrusions are formed at one side of the inner case, and a plurality of fixing holes are formed at one side of the drain hose such that the drain hose is coupled to the inner case by the plurality of fixing protrusions being inserted into the plurality of fixing holes, respectively.

17. The refrigerator of claim 16, wherein an inner space is formed between the inner case and the outer case, and the drain hose extends in the inner space.

18. The refrigerator of claim 17, wherein an insulator is foamed in the inner space after the drain hose is coupled to the inner case.

19. The refrigerator of claim 16, wherein a first surface and a second surface bent from the first surface are provided at one side of the inner case, and one or more fixing protrusions protrude from each of the first surface and the second surface.

20. The refrigerator of claim 19, wherein a connector mounted at one side of the inner case is provided at one side of the drain hose, and the connector is formed in a shape corresponding to those of the first surface and the second surface.

* * * * *